United States Patent [19]

Lex

[11] 4,023,990

[45] May 17, 1977

[54] DYNAMO OR ELECTRO BAND

[75] Inventor: Albert Lex, Dortmund, Germany

[73] Assignee: Hoesch Werke Aktiengesellschaft, Dortmund, Germany

[22] Filed: Sept. 29, 1975

[21] Appl. No.: 617,398

[30] Foreign Application Priority Data

Sept. 28, 1974 Germany ..... 2446509

[52] U.S. Cl. ..... 148/31.55; 148/2; 148/12 A; 148/31.57; 148/36; 75/123 D; 75/123 H; 75/123 L; 75/124

[51] Int. Cl.[2] ..... C22C 38/02; C22C 38/14

[58] Field of Search ..... 75/123 D, 123 H, 123 R, 75/123 L, 124; 148/36, 2, 111, 112, 12 A, 31.55, 31.57

[56] References Cited

UNITED STATES PATENTS

| | | | |
|---|---|---|---|
| 2,797,991 | 7/1957 | Laufle | 75/123 R |
| 3,518,080 | 6/1970 | Jarleborg et al. | 75/123 L |
| 3,671,336 | 6/1972 | Korchynsky et al. | 75/123 N |

FOREIGN PATENTS OR APPLICATIONS

| | | | |
|---|---|---|---|
| 2,156,124 | 7/1972 | Germany | 148/36 |
| 982,955 | 2/1965 | United Kingdom | 75/123 J |

*Primary Examiner*—Arthur J. Steiner
*Attorney, Agent, or Firm*—Walter Becker

[57] ABSTRACT

A steel composed of from 0.004 to 0.05% of carbon, from 0.10 to 4.0% of silicon, not in excess of 0.45% of manganese, not in excess of 0.60% of aluminum, from 0.030 to 0.250% of phosphorus, from 0.02 to 0.2% of zirconium, and the remainder iron with impurities inherent to the manufacturing process. The invention also includes the method of making a steel band which includes the steps of intermixing in liquid condition and in a vacuum from 0.004 to 0.05% of carbon, 0.10 to 4.0% of silicon, not in excess of 0.45% of manganese, not more than 0.60% aluminum, from 0.030 to 0.250% of phosphorus, from 0.02 to 0.2% of zirconium, and the remainder iron with impurities inherent to the manufacturing process, warm rolling the thus obtained composition into a band, pickling said band and cold rolling it, and subsequently passing the thus treated band through a continuous heating furnace while annealing said last mentioned band at a temperature of from 750° to 1250° C for a time period of from 1 to 7 minutes.

2 Claims, No Drawings

DYNAMO OR ELECTRO BAND

The present invention relates to a steel and also to a dynamo band or electro band made of such steel. It is known to produce a dynamo band with magnetization reversing losses of from 1.9 to 4.0 W/kg with alternating field magnetization of 1.0 T (50 Herz) with a thickness of from 0.35 to 1.0 mm of steel with a silicon content of from 1.0 to 2.0%, a starting carbon content in excess of 0.015%, and partially with an aluminum content of from 0.10 to 0.50%. To this end, the band or plate or foil is hot and cold rolled and subsequently for purposes of decarburizing and recrystallizing is annealed either in a continuous heating furnace or a pusher-type furnace, in a box-type furnace, or in a so-called open coil box annealing furnace. These known methods have the drawback that due to the alloys with silicon and/or aluminum they have low magnetic induction values at all field intensities and frequencies of the generated dynamo sheets or bands. Therefore, it has already been suggested to employ as dynamo band a steel which was vacuum treated in liquid condition and consists of less than 0.015% of carbon, 0.050% to 0.250% of phosphorus, the remainder iron with impurities inherent to the manufacturing process. This steel was hot rolled, pickled, cold rolled, and subsequently was decarburized in a continuous heating furnace at a temperature of 750° to 1100° C for a period of from two to seven minutes to less than 0.010%. As stated, this steel was used as a dynamo band with magnetization reversal losses of from 2.5 to 4.0 W/kg at an alternating field magnetization of 1.0 T (50 Herz) and a magnetic induction increased over silicon, said induction amounted to at least from 0.5 to 1.0 T with alternating field intensities between 5 and 300 A/cm (50 Herz). Instead of the treatment in the continuous heating furnace, according to the said known method, the steel may also be annealed in a closed furnace chamber stationarily at from 650° to 950° C for a time period of from 30 to 40 hours to less than 0.01% carbon.

It has furthermore been known to employ a steel with less than 0.03% carbon, less than 0.007% nitrogen, less than 0.35% manganese, less than 0.025% phosphorus, from 0.012 to 0.020% of sulphur, up to 0.3% aluminum, the remainder iron and impurities inherent to the manufacturing process, as well as with additions of titanium and/or niobium according to the equation: $\% Ti \geqq 3 \cdot \% (C + N)$, $\% Nb \geqq 6 \cdot \% (C + N)$ with the provision that with steel not cast in a quiet condition, an increase in the titanium content will be effected in conformity with the quantity of titanium intended to bond the oxygen content. This is done for the purpose of manufacturing magnetic sheets resistant to aging and for the manufacture of parts made or punched from said sheets. These parts were subjected to a final annealing in the continuous heating furnace with short stopping time and fast cooling-off. In order to be able to take advantage of the high cold deformation extent possible in modern cold rolling flights, it is necessary in conformity with known methods, for obtaining good values of the reversing magnetizing losses, after a cold deformation of approximately 60%, to carry out an intermediate annealing and a further critical 10 to 25% cold deformation with final annealing.

In the paper by H. Rachmantio, Technical University, Berlin 1967, also investigations are described concerning soft steels with a zirconium content of from 0.01 to 0.23%. These investigations indicated a clear increase in the coercive field intensity which means also of the reversal magnetization losses after recrystallizing annealing at temperatures of from 800° to 1200° C, and more specifically with steels which had been alloyed with more than 0.016% zirconium.

It is an object of the present invention to provide a steel and a method of its further processing, by means of which the reversal magnetization losses can with the same silicon and aluminum content as is customary with the heretofore known steels, be realized without additional processing steps.

These objects and other objects and advantages of the invention have been realized according to the invention by the utilization of a steel which in liquid condition has been subjected to a vacuum and which consists of 0.004 to 0.05% of carbon, 0.10 to 4.0% silicon, not more than 0.45% manganese, not more than 0.60% aluminum, from 0.030 to 0.250% phosphorus, from 0.02 to 0.2% zirconium, the remainder iron with impurities inherent to the manufacturing process, which steel is heat rolled, pickled, cold rolled and subsequently has been annealed in a continuous heating or push-type furnace at a temperature of from 750° to 1,250° C for a period of from one to seven minutes. This steel has then in conformity with the present invention been used as an electro band or a dynamo band. More advantageously, the cold rolled steel may also be annealed in a closed furnace chamber stationarily at 650° to 950° C for a period of from thirty minutes up to 24 hours.

The advantages of the steel to be employed in conformity with the present invention consists primarily in that with this steel and with the same silicon and aluminum contents as customary with heretofore known dynamo band steels, lower reversal magnetizing losses are suffered without a critical deformation and without the necessity of employing intermediate annealing. In this way, for purposes of obtaining low reversal magnetizing losses, the element silicon is partially or entirely replaced by the element zirconium.

There will now be set forth the preparation of the steel to be employed in connection with the invention, and also the obtained properties will be outlined in connection with the following examples. By means of an oxygen blowing method, the steels A-G are melted and subsequently are treated in liquid condition in a vacuum treating plant, while the steels B-D and F,G were alloyed with zirconium. The chemical composition of the steels following the vacuum treatment are illustrated in the following table:

Table 1:

| | C | Si | Mn | P | S | Al | Zr ges |
|---|---|---|---|---|---|---|---|
| A | 0.010 | 1.10 | 0.23 | 0.065 | 0.020 | 0.25 | — |
| B | 0.012 | 1.08 | 0.21 | 0.058 | 0.018 | 0.24 | 0.030 |
| C | 0.012 | 1.10 | 0.27 | 0.064 | 0.013 | 0.20 | 0.050 |
| D | 0.017 | 1.28 | 0.25 | 0.140 | 0.019 | 0.25 | 0.050 |
| E | 0.010 | 2.0 | 0.26 | 0.022 | 0.019 | 0.26 | — |
| F | 0.014 | 1.94 | 0.25 | 0.098 | 0.013 | 0.22 | 0.05 |
| G | 0.018 | 2.10 | 0.24 | 0.092 | 0.017 | 0.26 | 0.09 |

The steels A-G were following the casting and hot rolling thereof to a thickness of 2.0 mm pickled in a 20% hydrosulphuric acid at 98° C and were subsequently on a five-frame tandem street cold rolled without intermediate annealing to an end dimension of 1030 × 0.50 mm. The cold rolled bands were in a continuous heating furnace respectively at 900° and 1,050°

C and holding periods of respectively 2, 3, 4 and 5 minutes in an atmosphere of 8% $H_2$ and remainder nitrogen annealed in a decarburizing and recrystallizing manner.

The end carbon content measured at the samples A-G with a thickness of 0.50 mm after the annealing at 900° C with different holding periods and average values from longitudinal and transverse samples of the reversal magnetizing losses P 1.0 with an alternating field magnetization of 1.0 Tesla at 50 Herz are set forth in tables 2 and 3.

Table 2:

| Steel | Holding time (min) at 900° C 2 | 3 | 4 | 5 |
|---|---|---|---|---|
| A | 0.007 | 0.003 | 0.002 | 0.002 |
| B | 0.007 | 0.003 | 0.002 | 0.002 |
| C | 0.005 | 0.003 | 0.002 | 0.002 |
| D | 0.008 | 0.005 | 0.003 | 0.003 |
| E | 0.005 | 0.004 | 0.003 | 0.003 |
| F | 0.008 | 0.005 | 0.003 | 0.003 |
| G | 0.011 | 0.009 | 0.008 | 0.007 |

From this table it will be evident that with a starting carbon content of less than 0.015% at an annealing temperature of 900° C and from a holding period on of three minutes, carbon contents of 0.005% and less are obtained.

Table 3:

| Steel | Holding time (min) at 900° C 2 | 3 | 4 | 5 |
|---|---|---|---|---|
| A | 2.75 | 2.6 | 2.5 | 2.5 |
| B | not determined | 2.3 | 2.3 | 2.25 |
| C | 2.2 | 2.15 | 2.0 | 2.0 |
| D | 2.2 | 2.1 | 2.0 | 2.0 |
| E | 2.5 | 2.4 | 2.4 | 2.3 |
| F | 2.0 | 2.0 | 1.85 | 1.8 |
| G | 2.0 | 2.0 | 1.9 | 1.85 |

The average values measured after annealing at 1,050° C of the samples A-G with a thickness of 0.50 mm which average values were measured from longitudinal and transverse samples of the reversing magnetizing loss P 1.0 at an alternating field magnetization of 1.0 Tesla at 50 Herz are shown in Table 4.

Table 4:

| Steel | Holding time (min.) at 1050° C 2 | 3 | 4 | 5 |
|---|---|---|---|---|
| A | 2.2 | 2.2 | 2.2 | 2.2 |
| B | 2.15 | 2.1 | 2.1 | 2.1 |
| C | 2.0 | 1.9 | 1.8 | 1.8 |
| D | 2.0 | 1.9 | 1.8 | 1.8 |
| E | 1.9 | 1.9 | 1.9 | 1.8 |
| F | 1.55 | 1.5 | 1.45 | 1.45 |
| G | 1.65 | 1.6 | 1.6 | 1.6 |

The results set forth in Tables 3 and 4 show clear differences on one hand between the steels A and E without zirconium and on the other hand between the steels B to D and F, G which have been alloyed with zirconium in conformity with the invention. At an annealing temperature of 900° C, the steels C and D with a zirconium content of 0.05% have over steel A without zirconium, already after a holding period of two minutes P 1.0 values which are lower by 0.55 W/kg. With the steels F and G, at this temperature and likewise after a holding period of two minutes, the P 1.0 value is by 0.5 W/kg lower than with the steel of comparison E without zirconium. The improved values for the reversing magnetizing loss will also with other holding times be of similar proportional value.

Also at an annealing temperature of 1,050° C, the reversing magnetizing losses of the steels B-D and F,G composed and treated in conformity with the present invention are lower than the comparison steels A and E. Thus, the difference between the steels A, C and D after a holding time of three minutes amount to 0.3 W/kg and after a four-minute holding time to 0.4 W/kg. The values of the reversing magnetizing loss P 1.0 of the steels F and G are after holding time of two minutes lower than the values of the comparison steel E by 0.35 and 0.25 W/kg respectively, after three minutes are lower than the values of the comparison steel E by 0.5 and 0.3 W/kg respectively and after four minutes are lower than the values of the comparison steel E by 0.45 and 0.3 W/kg respectively.

As will furthermore be evident from the Table 5 below, an improvement, i.e. a reduction, was ascertained with the coercive field intensity with increasing zirconium content. The measurement was made in Oerstedt.

Table 5:

| Steel | Holding time (min.) at 900° C 3 | 4 |
|---|---|---|
| E | 1.42 | 1.3 |
| F | 1.14 | 0.96 |
| G | 1.02 | 0.93 |

The above samples are those of Table 3.

It is, of course, to be understood that the present invention is, by no means, limited to the specific examples set forth above, but also comprises any modifications within the scope of the appended claims.

What I claim is:

1. A dynamo or electro band made of a steel consisting of 0.004 to 0.05% of carbon, 0.10 to 4.0% of silicon, not more than 0.45% of manganese, not in excess of 0.60% aluminum, from 0.030 to 0.250% of phosphorus, from 0.02 to 0.2% of zirconium and the remainder iron with the usual impurities, said steel having been subjected to a vacuum while in the liquid condition and subsequently warm rolled, pickled, cold rolled and continuously annealed at a temperature of from 750° to 1,250° C for a time period of from 1 to 7 minutes.

2. The band of claim 1 wherein said steel has been continuously annealed at a temperature of from 650° to 950° C for a time period of from 30 minutes to 24 hours.

* * * * *